US006229082B1

(12) United States Patent
Masias

(10) Patent No.: US 6,229,082 B1
(45) Date of Patent: May 8, 2001

(54) MUSICAL DATABASE SYNTHESIZER

(76) Inventor: Hugo Masias, 1693 NE. 171st St., North Miami Beach, FL (US) 33162

( * ) Notice: Subject to any disclaimer, the term of this patent is extended or adjusted under 35 U.S.C. 154(b) by 0 days.

(21) Appl. No.: 09/612,988

(22) Filed: Jul. 10, 2000

(51) Int. Cl.[7] ..... G10H 7/00
(52) U.S. Cl. ..... 84/645; 84/670; 84/743
(58) Field of Search ..... 84/600, 609, 634, 84/644, 645, 649, 670, 743, 744

(56) References Cited

U.S. PATENT DOCUMENTS

| | | | | |
|---|---|---|---|---|
| 5,241,126 | * | 8/1993 | Usa et al. | 84/644 X |
| 5,425,297 | * | 6/1995 | Young, Jr. | 84/744 X |
| 5,824,933 | * | 10/1998 | Gabriel | 84/609 |
| 5,841,052 | * | 11/1998 | Stanton | 84/600 |
| 5,883,325 | * | 3/1999 | Peirce | 84/609 X |
| 5,915,288 | * | 6/1999 | Gabriel | 84/609 |
| 6,031,174 | * | 2/2000 | Takabayashi | 84/609 |
| 6,124,543 | * | 9/2000 | Aoki | 84/609 |

* cited by examiner

*Primary Examiner*—Jeffrey Donels
(74) *Attorney, Agent, or Firm*—Malloy & Malloy, P.A.

(57) ABSTRACT

An electronic musical synthesizer comprising a keyboard assembly including at least one main keyboard controller and one or more support keyboard controllers. The main keyboard controller includes ergonomically configured keypads each of which include two keyrows, wherein each keyrow preferably comprises either five keys or six keys. The keyboard assembly through the plurality of keyboard controllers operatively communicates with a processor assembly comprising a retrieve processor and an assemble processor each of which communicate with the keyboard assembly to receive different MIDI language, key-velocity primary parameters including pitch, velocity and channel. Target database information is selected and retrieved from a database assembly communicating with each of the retrieve and assemble processors, wherein a complete MIDI message is Ad formulated by the assemble processor from selected ones of the key-velocity parameters and the target database information, representing pre-scripted musical sound, from the database assembly. The completed MIDI message is transferred to a synthesis engine for the production of the intended sound, by means of audio signals, which in turn are transferred to conventional audio output hardware.

43 Claims, 4 Drawing Sheets

| LEFT HAND TRACK | | | | | | SCRIPT | RIGHT HAND TRACK | | | | |
|---|---|---|---|---|---|---|---|---|---|---|---|
| LH | G1 | G2 | G3 | G4 | G5 | RH | G1 | G2 | G3 | G4 | G5 |
| 1 | D3 | | F3 | | A3 | 1 | D4 | F4 | A4 | Bb4 | |
| 2 | G3 | | Bb3 | | D4 | 2 | C4 | E4 | F4 | G4 | A4 |
| 3 | C3 | | E3 | | Bb3 | 3 | | Bb3 | D4 | F4 | A4 |
| 4 | F3 | | A3 | | C4 | 4 | | D4 | E4 | F4 | G4 |
| 5 | Bb2 | D3 | | F3 | Bb3 | 5 | A3 | B3 | C#4 | D4 | E4 |
| 6 | G2 | E3 | G3 | | Bb3 | 6 | E4 | F4 | G4 | A4 | D5 |
| 7 | A2 | | E3 | | G3 | 7 | G4 | | Bb4 | C5 | D5 |
| 8 | D3 | | F3 | | A3 | 8 | Eb4 | F4 | G4 | A4 | Bb4 |
| 9 | G3 | | Bb3 | | D4 | 9 | D4 | E4 | F4 | A4 | D5 |
| 10 | C3 | | E3 | | Bb3 | | | | | | |
| 11 | F3 | | A3 | | C4 | | | | | | |
| 12 | C3 | D3 | Eb3 | G3 | Bb3 | | | | | | |
| 13 | A2 | Bb2 | D3 | F#3 | C4 | | | | | | |
| 14 | D3 | F3 | | A3 | D4 | | | | | | |

MUSICAL DATABASE SYNTHESIZER

BACKGROUND OF THE INVENTION

1. Field of the Invention

This invention relates to an electronic musical database synthesizer assembly comprising at least one keyboard controller uniquely structured into ergonomically configured keypads each of which may include two key rows, each key row comprising a plurality of keys. Each of the one or more keyboard controllers operatively communicates with a processor assembly for purposes of selecting predetermined data entries from a database assembly and concurrently transferring predetermined key velocity parameters for subsequent formation of a complete formatted message output which is transferred, on a real time basis, to a synthesis engine, wherein the complete formatted message output is determinative of a predetermined sound output in the form of audio signals, produced by a synthesis engine.

2. Description of the Related Art

Acoustic musical instruments are formidable music making tools able to produce rich expressive sound. The complexity and variety of sound generated by such modern musical instrumentation are the result of countless physical laws and acoustic phenomena associated with the instruments being utilized. There is a close relationship between body, materials and play dynamics, which results in the sound that is eventually produced. If a musician wanted to take advantage of the best sound potential available he or she would be forced to master many different musical instruments which is generally recognized as an impractical, if not impossible proposition. However, through the development and significant technological advancement of the modern electronic musical synthesizer, a musician's freedom in creating a variety of different sounds and an eventual musical composition is almost unlimited. Electronic musical synthesizers are generally universal sound making machines, which generate sound electronically. There are no physical or natural ties between the hardware and the sounds that are being produced. Accordingly, modern day electronic musical synthesizers can produce different types of sounds, thereby providing the musician with a unique freedom of choice in sound when composing and performing. Also, modern synthesizer technology has advanced to the point that there is virtually no sound that cannot be duplicated electronically.

Modern musical synthesizer instrumentation is essentially composed of four distinct elements. First, the synthesis engine which refers to audio electronic hardware that generates sound, in terms of audio signals, for musical applications. Second, controllers, which refer to devices that musicians use to drive and control a synthesis engine. Controllers typically include piano keyboards, foot pedals and other music making interface devices. Third, the sequencer, a computer based device which records, edits and plays back a multi-track song by generating and manipulating data which represents and describes music. Fourth, Musical Instrument Digital Interface (MIDI) which is a communications standard protocol or "language" universally recognized as the standard communications language for synthesizers. More specifically, MIDI is a stream of digital data which describes musical events and enables musicians or others to use multi-media computers and electronic musical instruments to create, enjoy and learn about music.

Due to the advancement in the electronic synthesizer technology sound generation has developed to the point where further technological advancements may best concentrate on efforts directed to sound control, rather than the extremely well developed field of sound generation. Therefore, a crucial element in such advancement is not the availability of synthesized sounds, but rather in how to control synthesized sounds, when playing, in more flexible and powerful ways.

The piano keyboard has long established itself as the musical interface of choice in synthesizer instrumentation. This general preference is well grounded for a number of reasons. Most significantly, the piano keyboard is a powerful musical tool which, by learning and mastering a single musical interface, namely the traditional keyboard, the musician can play different instrumental voices and thereby perform songs with a high degree of versatility and flexibility.

In spite of all the recognized achievements and technological advancements in modern day musical synthesizer technology, the simple fact remains that current generation synthesizers are highly specialized computers. Proper utilization of the synthesizer can produce any sound desired by specifying the desired sound in terms of a simple digital message. Keyboard keys become entirely programmable and MIDI is the digital communications format, protocol or language governing the operation for virtually all synthesizers. Due to their nature, conventional keyboard synthesizers cannot produce MIDI events in a manner which allows musicians an even more expanded range of versatility. Accordingly, further technological advancements should be primarily based on the achievement of total control over sound and sound production through the processing of the MIDI language, taking full advantage of the resources that the MIDI language provides.

Therefore, there is a need in the musical arts for a truly "full capability" synthesizer, wherein individual sound components may serve as building blocks to play any music through the activation of a key on a uniquely styled ergonomically configured keyboard, which is greatly reduced in complexity from the conventional 88-key piano keyboard. Such an improved electronic musical synthesizer should be database driven and be free from any one musical interface, especially including the piano keyboard. The preferred keyboard controller, specifically designed to have a significantly lesser number of keys, allows for high play comfort, extremely fast event triggering and rhythmic control. For these reasons, such an improved electronic musical synthesizer should represent a unique and radical departure from the conventional modern day music synthesizer, by allowing the musician to establish full control of the sound generated.

SUMMARY OF THE INVENTION

The present invention is directed to an electronic, database driven, musical synthesizer comprising specialized keyboard hardware as the musical interface for the control, activation and operation of an included operating or control system. More specifically, the invention includes at least one keyboard controller and preferably a plurality of at least two additional support keyboard controllers. The main keyboard comprises two ergonomically configured keypads, disposed and dimensioned to be operated by different hands of the user. This main keyboard controller, as well as the aforementioned support keyboard controllers, to be described in greater detailed hereinafter, actively manipulate the Musical Instrument Digital Interface (MIDI) data and events internally through the provision of an operatively communicative processor assembly.

The processor assembly comprises at least a retrieve processor and an assemble processor, which are responsive to or are connected in operative communicating relation with a database assembly. The keypads of the main keyboard, as well as the one or more support keyboard controllers, comprise a predetermined number of keys. These keyboard keys, however, generally do not trigger a set of predefined sounds the way conventional synthesizers do. Rather, activation of each of the keys serves to communicate MIDI information parameters, also known as MIDI language, key-velocity parameters comprising pitch, velocity and channel, to the processor assembly. However, initially a plurality of predetermined data entries must be created in order to define the aforementioned database assembly. The predetermined data entries are scripted or "pre-programed".

More specifically, the "music-making" process is divided into two basic phases. First, a user creates or "scripts" the predetermined data entries, defining the database assembly by writing down MIDI data. The created database represents a concrete song or alternatively musical segments or sections defined in the MIDI format or language terminology. Second, the user or musician physically operates the main keyboard controller and/or support keyboard controllers in a natural or conventional piano style fashion. The resulting song or sound generated is based on the database assembly created by the user, musician or other personnel.

The processor assembly of the present invention, is structured to keep track of each physical keyboard play activity. More specifically, the processor assembly as well as other associated operative components, are structured to identify and follow each and every key-play event regardless of the key sequence being performed. This capability allows the processor assembly to support all play activity with essential MIDI data and accordingly allows the user or musician to exercise complete control of the synthesis engine, which is also incorporated in and made a part of the electronic musical synthesizer of the present invention.

In operation the activation of any keyboard controller results in the generation of the essential parameters of sound which, as indicated above, comprise pitch, velocity and channel. However, the pitch parameter does not represent a fixed MIDI note or predetermined sound. Instead, the pitch parameter is used as a path or "code" to the database assembly and serves to access pre-programmed, and specifically intended "database target information" defined by one or more of the predetermined database entries of which the database assembly is comprised. Meanwhile, the velocity parameter also obtained or generated from the keyboard performance reflects the play activity and the play dynamics. The channel and velocity parameters are subsequently assembled, on a real time basis, with partial MIDI information, retrieved by means of directing the "code" pitch parameter to the database assembly, wherein the assembled information is represented by a complete MIDI message which is transmitted to the synthesis engine and is thereby determinative of the authentic and natural sound output generated thereby, in the form of audio signals. The audio signals are of course transferred to an audio output hardware, such as appropriate stereo components, speaker, etc.

Due to the cooperative structuring and communicative interaction of the various components of the present invention, a user may script and perform any number of songs or other musical segments or passages. The aforementioned database may be provided in RAM memory and individual works or compositions may be stored, while not being performed, on a fixed drive or using conventional storage media, such as the compact disk or floppy disk. When it is desired to play a specific song or musical passage, the storage medium is loaded into the database assembly thereby placing the corresponding "MIDI file" back into the operative system of the present invention. The power and versatility of the database assembly designed and structured in the manner set forth herein presents a new vista to music making opportunity. Technically key-events (play actions of each and every key) may trigger any type of MIDI message. Musically this results in total freedom in music production in terms of synthesizer technology and instrumentation. Since the present invention can generate multiple key velocity messages in any combination, single notes or chords based on one or multiple voices can be played out upon a single key stroke.

In addition, since play activity is not limited to a conventional 88 piano keyboard controller interface, there is no physical relation between keys and sounds that can be generated. Therefore, a variety of musical systems ranging from Arabic music to ancient Greek scales and including Chinese musical formats, can be utilized. Also, utilization of the processor assembly, in combination with the database assembly, as described herein, provides the opportunity for a high number of sound elements to be activated. This enables a user to produce highly detailed expressive guitar samples or other instrument voices. Also voiced instrumental patches may be mixed and combined with percussive sound families during the performance.

In addition, to the above the ability to formulate one's own selected, predetermined data entries to define the database assembly provides the ability to automate system wide functions and completely control the operation, activation and "behavior" of the synthesizer of the present invention. In addition, since the function and structure of the present invention exceeds the utilization of conventional MIDI format and protocol, designs may be incorporated which are directed to new types of synthesizer functionality. More specifically, by combining unique control change messages and key velocity messages or by using system exclusive message, the synthesizer assembly of the present invention is able to produce complex sound wave and sophisticated musical texture which, by way of example, could result in the programing and performance of vocals in the form of a synthesized singing voice. Vocals production could be controlled by linking syllables and tones together and specifying the individual sound elements. A key sequence could be performed which generates melody based on pitch and lyrics based on phonemes, concurrently on a real time basis.

While one embodiment of the present invention contemplates the use of an industry standard MIDI synthesis engine to produce sound, it is contemplated that an advanced version could incorporate a synthesis engine specifically designed to interpret unique instructions, access a higher number of sound elements, as well as generate, modulate and morph sound in more powerful ways than is currently capable utilizing conventional synthesis engines in combination with current synthesizer technology. The electronic musical synthesizer of the present invention could therefore take full advantage, unlike current synthesizer technology, of more sophisticated synthesis architecture.

The versatility of the musical synthesizer assembly of the present invention is further demonstrated by the ability to use a unique music notation system which may be easily read, or written and simplify the learning and playing of the created musical composition. Such a unique music notation layout system would resemble a conventional standard score but be more specifically characterized by a simplified version of modern piano music notation. More specifically a two stave score system would be used to notate two hand play (left and right hands of the player). Most of the standard or conventional symbols and features, including basic layouts, stave system, bar lines, meter signatures, tempo related convention and music dynamics, could be retained. Essentially the basics all remain the same with the exception of the pitch parameter. In the environment of this unique music notation system, pitch notation would not be required. Therefore key signature is non-existent and accidentals would not be needed. Further, music notation would be greatly simplified. In the utilization of the unique, main keyboard controller, as set forth in greater detail hereinafter, only five keys would be represented. Accordingly, instead of so many different notes to learn and memorize, as in conventional music notation, a player must only deal with five note symbols which actually represent keyboard keys rather than musical notes.

Finally, the musical synthesizer of the present invention would be structured to be highly modular and capable of being expanded into a complete musical production system including a standard piano controller and conventional support controllers, such as pedals, wheels, sequencers, score systems, etc. and further including additional computer and printer components, audio system components and a variety of other associated and related hardware and software a user may need to adapt the synthesizer assembly of the present invention to facilitate making of musical sound.

These and other features of the present invention will become more clear when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

The present invention is directed to an electronic musical synthesizer incorporating a variable, pre-programed database assembly structured to be operational preferably utilizing the internationally conventional MIDI format or protocol language. It is recognized that MIDI is not the only industry standard communications protocol. Therefore, it is emphasized that while the musical database synthesizer of the present invention is primarily described herein as using the MIDI format, this invention is designed and structured to also operate on communications protocols or "languages" other than MIDI.

Figure 1:
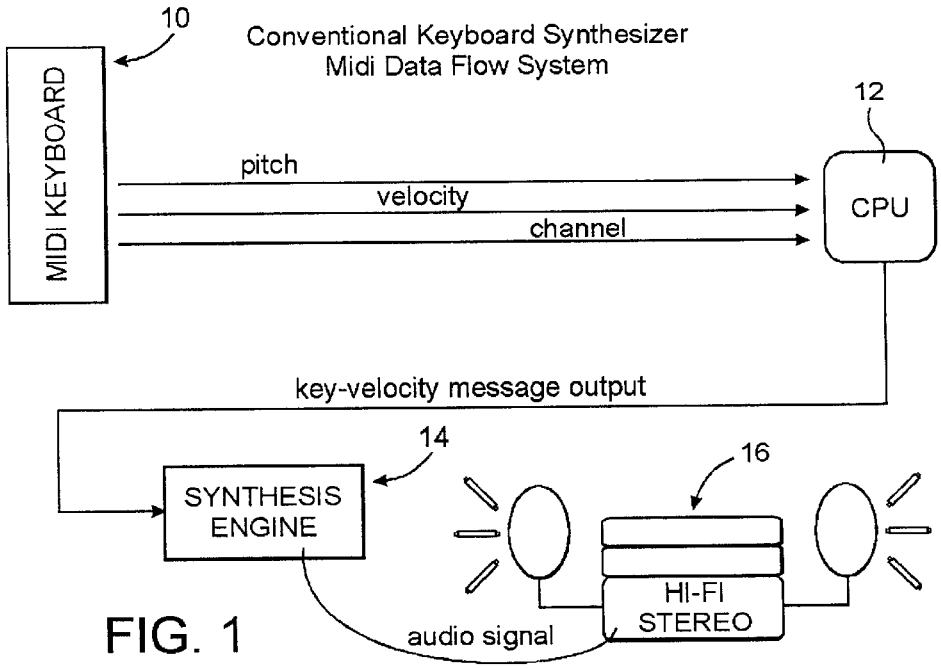
FIG. 1 PRIOR ART
FIG. 1 is a schematic representation of a conventional prior art musical synthesizer incorporating a MIDI language data it flow system.

In order to appreciate the structural and operational advantages over conventional modern day electronic synthesizer instrumentation, FIG. 1 is representative of a typical prior art keyboard synthesizer utilizing data in the MIDI format or language. Utilizing the internationally recognized MIDI language, a key-velocity message controls the basic keyboard/key play action in activating or controlling note-on and note-off events, as well as the control of sound dynamics. As is well accepted and discussed in detail above, a key-velocity message generated by the activation of the individual keys, such as on a conventional keyboard assembly, generally indicated as 10 in the prior art representation of FIG. 1, comprises three primary parameters; pitch, velocity and channel. In a conventional synthesizer, upon the implementation of a key stroke, the keyboard controller 10 generates pitch, velocity and channel parameters and sends them to a processor or CPU generally indicated as 12. The CPU 12 performs at least two ordinary or basic routines. First, the CPU 12 monitors and optionally modifies the incoming parameter values. Second, it assembles a key-velocity message output which is transferred to the synthesis engine generally indicated as 14, which then produces sound in the form of audio signals, which is then transferred to the audio output in the form of stereo components including speaker etc. and generally indicated as 16. However, in conventional keyboard synthesizer operation and structure, the basic nature of key-velocity does not change, in that it is assembled, immediately on an "as is" basis. The resulting message output is transferred to the synthesis engine, which produces sound, as set forth above. In addition, in conventional synthesizer technology the three primary parameters may be manipulated to a certain extent, such as the adding or subtracting of a constant value from the pitch or an ordinary tone range being transposed. Similarly, the velocity parameter may be adjusted according to a pre-selected play action dynamic curve response. Also the channel parameter may be changed according to a specific MIDI set-up configuration or multi-track arrangement. However, the resulting key-velocity message output in the form of a MIDI message represents and reflects a common keyboard performance, namely, one based on the true nature of the piano keyboard icon and an individual instrumental sound or patch preset.

Figure 2:
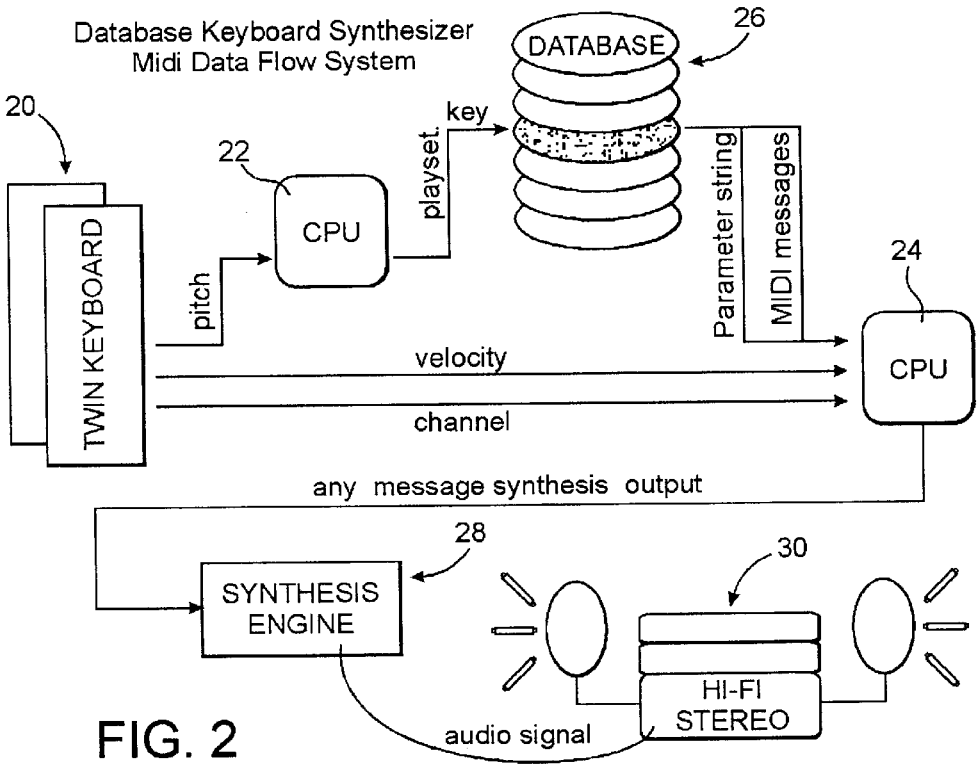
FIG. 2 is a schematic representation in flow chart form of the structure and operation of a musical synthesizer assembly of the present invention utilizing MIDI language.

With primary reference to FIG. 2, the structural and operational features of the musical synthesizer assembly of the present invention are quite different. As with conventional synthesizer instrumentation, the present invention incorporates a keyboard assembly comprising at least a main keyboard controller, generally indicated as 20. As will be explained in greater detail hereinafter, the main keyboard controller 20 has a unique structure incorporating an ergonomic configuration and further may comprise an additional number of support keyboard controllers, also to be described in greater detail hereinafter. Again with reference to FIG. 2, the main keyboard controller 20 generates the three primary parameters defining the key-velocity message, namely; pitch, velocity and channel, through individual play action on the individual keys of the main keyboard controller and/or any of the one or more support keyboard controllers. However, the treatment or processing of the pitch, velocity and channel parameters is significantly different than in conventional synthesizer instrumentation as generally represented in FIG. 1. More specifically, the three primary parameters are transferred to a processor assembly, which comprises a retrieve processor, generally indicated as 22 and structurally represented by a central processing unit (CPU) or other processing hardware and an assemble processor, generally indicated as 24, also in the form of a central processing unit (CPU) or other applicable processing facility. The structural and operational components of the present invention determines that the pitch parameter is not associated with the fixed predetermined MIDI events associated with the conventional synthesizer technology of FIG. 1. Rather, the pitch parameter is internally used as a path or "code" and directed to a database assembly generally indicated as 26.

A database assembly comprises or is at least partially defined by a plurality of predetermined data entries which collectively define a plurality of "playsets". Each playset may be more specifically defined by a set of MIDI information which defines and is controlled by at least one key of the keyboard assembly, including at least the main keyboard controller 20. The role of the playset and its communicative relation to the individual keys of the main keyboard controller 20 will be described in greater detail hereinafter. Again with reference to FIG. 2, the segregation of the pitch parameter from the velocity and channel parameters as indicated, allows the processor assembly, particularly the retrieve processor 22 to seek, find and retrieve specific, pre-stored, predetermined data entries comprising the database assembly 26, wherein each data entry is represented by specific MIDI information which the user may add to or remove from the database assembly at any time when writing down or editing the script. Therefore, as set forth above, the pitch parameter behaves like a code wherein its value directly determines the targeted MIDI information that is to be retrieved from the database assembly 26 and transferred to the assemble processor 24. It is also to be noted that in general, once the particular predetermined data entry or MIDI information has been selected and retrieved, it will result in two different types of information being delivered to the assemble processor 24. These include a number of individual parameters or a "parameter string" as well as a number of different MIDI messages as shown in FIG. 2. In its simplest form a single parameter, the pitch parameter, is identified as "code" input by the retrieve processor 22 which accesses the database assembly 26 and retrieves the corresponding MIDI information output. Also, in its simplest form the "code" input received by the retrieve processor 22, may retrieve a single pitch parameter value as the target MIDI information output from the database assembly 26. However, the "code" input may retrieve more information than a single pitch parameter value thereby resulting in the delivery from the database assembly 26 of the parameter string and plurality of MIDI messages being concurrently transferred on a real time basis to the assemble processor 24. Collectively the parameter string and the one or more MIDI messages may be considered or represented as a "target database information" retrieved from the database assembly 26 and sent on to the assemble processor 24. It should also be noted that while FIG. 2 discloses that the pitch parameter represents the "code" delivered to the retrieve processor 22, it is possible that an additional parameter, such as the channel parameter, may be generated together with the pitch parameter to serve as a source code for the retrieve processor 22. Therefore at least one of the MIDI language parameters is communicated to the retrieve processor 22 and a remainder of the MIDI language parameter are communicated directly to the assemble processor 24. It is also to be noted that the source code "value" input, which may be based on the pitch parameter or the combination of the pitch parameter and channel parameter, may retrieve either a single pitch value or alternatively a parameter string and a plurality of MIDI messages as the output from the database 26.

As set forth above, the velocity and channel parameters are sent directly from the main keyboard controller 20 to the assemble processor 24. Accordingly, upon receipt of the velocity and channel parameters, as well as the aforementioned target database information from the database assembly 26, the assemble processor 24 receives a complete input. Based on this input data the assemble processor 24 decides on how to assemble or formulate a ready to execute "complete MIDI message" and generate the complete MIDI message as an output. The specific programming and structuring of the assemble processor 24 therefore allows it to monitor the input data as set forth above process it and importantly, decide how to assemble the received parameter information with the target database information received from the database assembly 26. While the keyboard originating data in the form of the velocity and channel parameters is always the same, the target database information, comprising the parameter string and the partial MIDI message is not. In performing its intended function, the assemble processor 24 assembles one or more ready to execute complete MIDI messages and defines such complete messages as output. The completed MIDI message produced can then be directly and effectively transmitted to the synthesis engine. The result is that the synthesis engine 28 is not required to process the information any further once such information is received, but rather obediently generates the intended sound instantly on a real time basis and, at least to a minimal extent, carries out its intended function and/or assignment in a compatible manner with conventional synthesizer technology. Sound output is thereby produced in the form of audio signals, which are transfer to a sound output assembly, generally indicated as 30, which may typically be in the form of stereo components and speakers or other applicable audio output equipment or facilities.

In the operation and processing of data utilizing the musical synthesizer assembly of the present invention, pitch is the fundamental parameter. Pitch will always be replaced by predetermined data entries, in the form of a plurality of scripted "playsets" originated by the user of the synthesizer assembly of the present invention. Such a scripted composition is represented schematically in FIG. 9 and will be described in greater detail hereinafter. The fact that pitch will always be replaced by predetermined database entries defining the database assembly 26, is of significant importance. More specifically when a key of a keyboard controller 20 is stroked, "common" pitch, velocity and channel parameters are generated. These parameters are pure expression of a musician's performance action and play dynamics. Pitch generates true physical key values. Velocity generates note-on, note-off and note-on dynamics. Channel refers to a pre-set MIDI channel system. Therefore, the source pitch value represents a physical keyboard key while the destination pitch value is the specific single piano tone we wanted the key to produce upon play. It should therefore be apparent that the musical synthesizer assembly of the present invention mixes live performance information with the selected predetermined data entries or "target database information"

from the database assembly 26, as a musician plays along in an intended prescribed order to produce the essential MIDI key-velocity message which is eventually delivered to the synthesis engine 28, resulting in the output of sound through the generation of audio signals to the output sound hardware 30.

As set forth above, the synthesizer assembly of the present invention comprises a keyboard assembly including at least a main keyboard controller 20, shown in its various embodiments in FIGS. 3 through 5, as well as at least one, but preferably a plurality of support keyboard controllers as disclosed in FIG. through 8 and discussed in greater detail hereinafter. More specifically, the main keyboard controller 20 comprises a keyboard platform generally indicated as 32 and horizontally disposed on an exterior portion of the synthesizer assembly of the present invention in an accessible location. Further, the main keyboard controller 20 preferably comprises at least two keypads generally indicated as 34 and 36, each of which are ergonomically configured as well as being disposed and dimensioned to facilitate being "played" by one of the two hands of the user. As should be apparent, the keypad 34 is designed to be operated by the left hand of the user and the keypad 36 is designed to be operated by the right hand of the user. Each of the keypads 34 and 36 may be disposed in spaced apart relation to one another and relatively oriented so as to facilitate contact of the individual keys 38, 38' and 40, 40' with the corresponding fingers of the left and right hand of the user. Further, both keypads 34 and 36 are symmetrically identical to each other in shape and size and the aforementioned ergonomic configuration is such as to correspond and essentially reflect human hand anatomy as well as the natural position of each of the hands of the user, such as when playing a piano.

In a preferred embodiment of the present invention, each of the keypads 34 and 36 comprise two keyrows, wherein in keypad 34 the first keyrow 33 is defined by a plurality of laterally spaced apart keys 38 and wherein the second keyrow 33' is defined by the same number of laterally spaced apart keys 38'. Similarly, right hand keypad 36 comprises a first keyrow 35 defined by the plurality of laterally spaced apart keys 40 and a second keyrow 35' is defined by the same number of laterally spaced apart keys 40'. As is clearly disclosed each keyrow 33,33' and 35,35' of each keypad 34 and 36 respectively, comprises a plurality of keys intended and designed to be operated by a corresponding "dedicated" finger of a corresponding hand of a user. The individual keys of each keyrow of each left hand keypad 34 and right hand keypad 36, have a substantially equal dimension and configuration which may vary. Represented in both FIGS. 3 and 4 individual keys 38, 38' and 40, 40' may preferably measure about 3.5 centimeters by 1.8 centimeters and as represented in FIG. 5, may also have different configurations than a multi sided or rectangular configuration represented in the embodiments of FIGS. 3 and 4. In addition, in an effort to conform to the aforementioned ergonomic configuration, each of the keyrows 33, 33' and 35, 35' have a somewhat curved or arcuate configuration and include only 5 keys in defining each of the keyrows 33, 33' and 35, 35'. FIG. 4 represents a right hand keypad 36 and, for purposes of clarity will be described in a manner which is meant to include the structural features of both of the symmetrically equivalent keypads 34 and 36. As represented the twin keyrows 35 and 35' are placed substantially parallel to one another in the aforementioned arcuate or curvilinear configuration and in a horizontal plane. Since both keyrows 35 and 35' are to be played by the same hand such keyrows are disposed as close to one another as is practical without having the individual keys 40 and 40' of each keyrow 35 and 35' overlapping one another. Further, the relative position of the keyrows 35 and 35' may be considered to be longitudinally spaced from one another in that each of the keyrows 35 and 35' are played by either extending the hand longitudinally forward or longitudinally rearward, depending upon which keyrow is being played. Another structural feature may be incorporated in each of the embodiments of the various keypads 34 and 36 of FIGS. 4 and 5 and, in certain applications, in the support keyboards shown in FIGS. 6 and 7, to be described in greater detail hereinafter. More specifically, the location of the two keyrows 33, 33' and 35, 35' etc. may be disposed at different levels or elevations. This structure could be compared to the relative positioning or orientation of the "black" and "white" keys on a conventional piano keyboard. By way of specific example, and with reference to the embodiment of FIG. 4, the keys 40' defining the keyrow 35' could be elevated or disposed at a higher level than the keys 40 defining the keyrow 35. As set forth above, similar structuring or positioning of the individual keys or pads of the various embodiments of FIGS. 6 through 8 could also be incorporated in the intended scope of the present invention.

Each keypad 34 and 36 defines a ten key system, wherein five keys are located on each of the keyrows. The upper or outer most keyrows 33' and 35' may be color coded so as to have a different appearance, at least in color, from the lower or inner most keyrows 33 and 35. The result of the utilization of the two keypad system, comprising keypads 34 and 36 and further wherein each keypad 34 and 36 is defined by two keyrows 33, 33' and 35, 35' respectively, results in significant simplicity in learning to play the main keyboard controller 20, without having to master the difficult piano playing techniques of a conventional 88 key keyboard. Each of the keys 38, 38' and 40, 40' may feature a variety of different structures including a simple spring biased, non-weighted key action system or, by way of example only, a hammer-based full weighted dynamic key action system.

Figure 3:
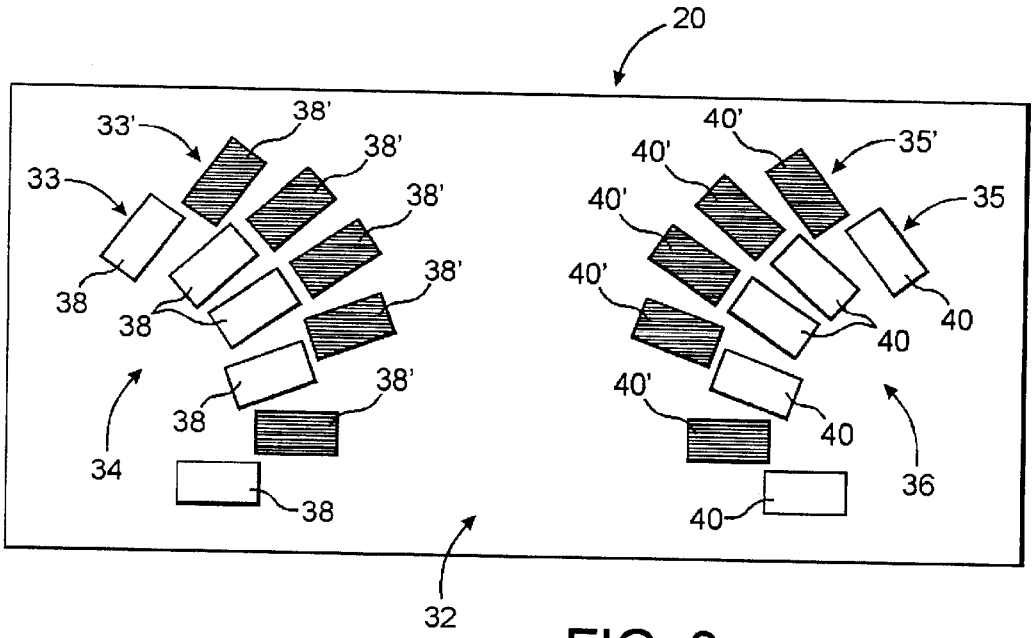
FIG. 3 is a top plan view of one embodiment of a main keyboard controller incorporating two ergonomically configured keypads.
Figure 4:
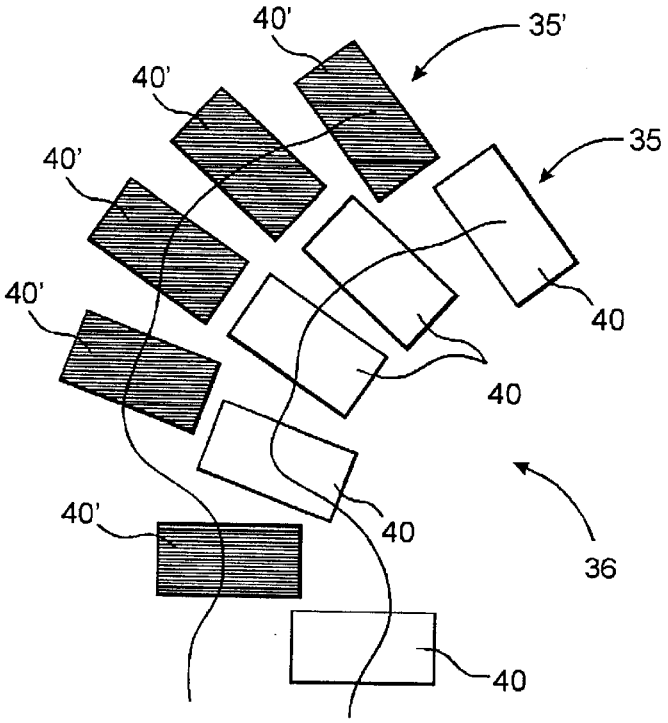
FIG. 4 is a detailed view of one of the keypads of the embodiment of FIG. 3.
Figure 5:
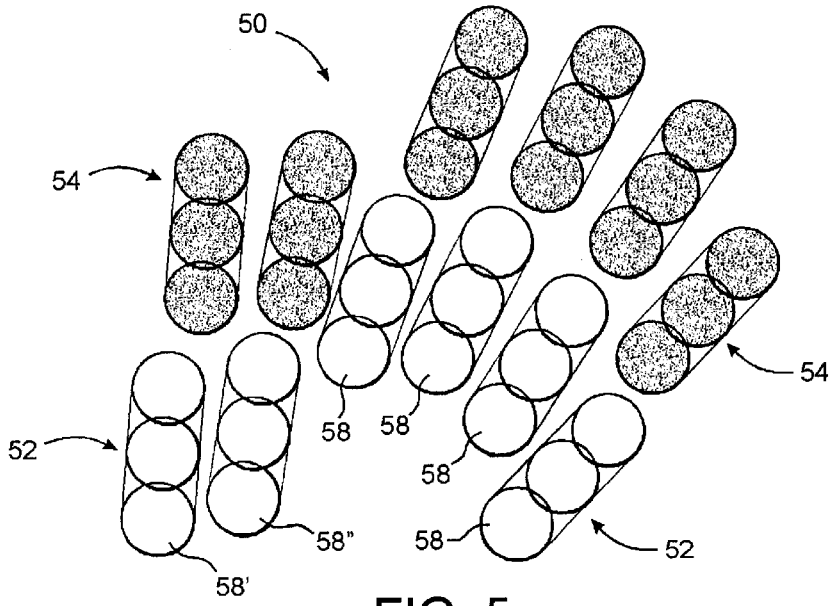
FIG. 5 is a detailed view of another embodiment of a keyboard controller, differing from the ergonomic configuration of the embodiments of FIGS. 3 and 4.

With reference to FIG. 5, another embodiment of each of the keypads associated with the main keyboard controller 20 comprises both a right hand keypad 50 and a left hand keypad icc (not shown) both including a plurality of keyrows 52 and 54 each comprising a predetermined number of keys, wherein each keyrow 52 and 54, includes six keys 58, 58' and 58" instead of the five keys demonstrated in the keyrows 33, 33' and 35, 35' of keypads 34 and 36 of FIGS. 3 and 4. The utilization of at least six keys in each of the two keyrows 52 and 54, is based on the fact that the thumb, unlike the other fingers is easily capable of moving sideways with comfort and versatility. Therefore, instead of each keyrow containing at least five keys, one for each finger, the embodiment of FIG. 5 has at least one, but preferably each keyrow 52 and 54 including at least six laterally spaced apart keys 58, 58' and 58", wherein adjacently positioned but laterally spaced apart keys 58' and 58" are both operable by the lateral displacement of the thumb, which, as set forth above, can occur easily and efficiently.

Figure 6:
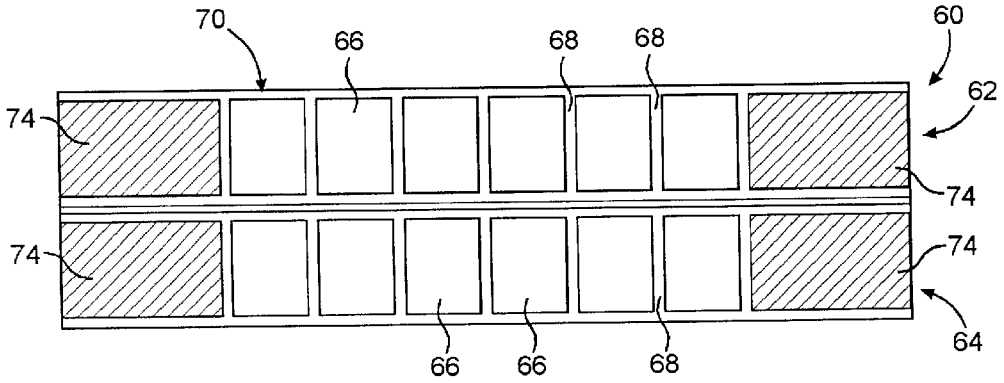
FIG. 6 is a top plan view of one embodiment of a support keyboard controller of the present invention.
Figure 7:
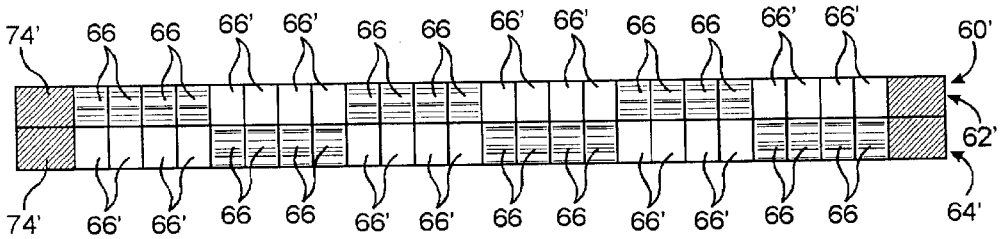
FIG. 7 is another embodiment of a support keyboard controller of the present invention.
Figures 8, 9:
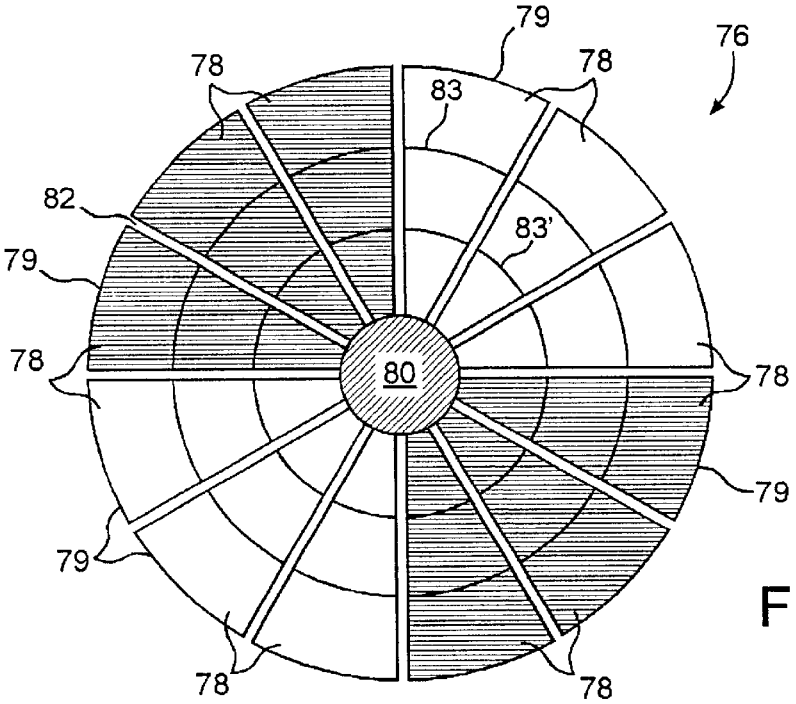
FIG. 8 is yet another embodiment of a support keyboard controller of the present invention.
FIG. 9 is a script format of predetermined data entries which comprise a portion of a database assembly.

As indicated herein the keyboard assembly of the present invention comprises at least one but preferably a plurality of support keyboard controllers in addition to the main keyboard controller 20, as described in FIGS. 3 through 5. Each of the various embodiments of the support keyboard controllers, as primarily disclosed in FIGS. 6 through 8, are intended to occasionally replace the main keyboard controller 20, in that they allow a user or a musician to play in ways a "piano style" main keyboard controller 20 normally does not. As emphasized further, each of the embodiments of the control keyboard controllers are electronic flat keyboards, meaning that they have no moving parts, no active keys and no dynamic key motion. Each of the keys, of the various embodiments of the support keyboard controllers are activated by microelectronics and sensing devices, which are widely available in the industry. For purposes of clarity in distinguishing the support keyboard controllers of FIGS. 6 through 8 from the main keyboard controller 20 of FIGS. 3 through 5, the keys of the support keyboard controllers will be referred to as "pads". However, it is herein emphasized that the keys in the embodiment of FIGS. 3 through 5 and the pads of the embodiment of FIGS. 6 through 8 are functionally equivalent, particularly in the activation and operative communication with the processor assembly, including the retrieve processor 22 and the assembly processor 24.

One embodiment of the support keyboard controller is disclosed in two different structural variations in FIGS. 6 and 7. As shown therein, a support keyboard is defined by a pad-ribbon controller, in the embodiment of FIG. 6 and is generally indicated as 60. The support keyboard controller 60 comprises two adjacently and substantially parallel keyboards 62 and 64, which may be fixedly or separably disposed relative to one another. Each of the keyboards 62 and 64 is evenly divided into individual pads 66 which are separated from one another in a laterally spaced, relative orientation by a tangible physical border 68. The separating borders 68 may assume a variety of different structural configurations including cross-cutting dividing lines or draft imprint structures, including painted or printed vertical lines drawn on the exposed playing surface, generally indicated as 70. Preferred dimensioning of the pads 66 vary from approximately 1 centimeter to 3 centimeters in width, wherein the separating borders 68 are dimensioned from substantially 0.10 centimeters to substantially 0.30 centimeters. In addition, a border 74 is provided on each opposite end of each of the two keyboards 62 and 64. Accordingly, each of the two keyboards 62 and 64 are specifically disposed in a linear array of pads 66, thereby allowing the musician or user to activate or touch the pad 66 individually or by sliding a finger tip along the length of keyboard 62 and 64 in either direction.

FIG. 7 represents yet another embodiment of a support keyboard controller 60' which includes a pad-ribbon structure, wherein each of the keyboards 62' and 64' may have a varying number of individual pads 66. When a larger number of pads 66 are provided on each of the keyboards 62' and 64', they may be segregated by color, wherein each of the pads 66 and 66' within a predetermined pad set, are different colors so as to be clearly and easily distinguishable from one another. Specifically in the embodiment of FIG. 7 a suitable two color pattern layout is utilized, wherein four consecutively disposed white pads 66' are located between and/or immediately adjacent to four consecutively disposed blue pads 66. End borders 74' may be provided as indicated. As set forth above the internal processing of the support keyboard controller embodiments of FIG. 6 and 7 are substantially equivalent to the main keyboard controller 20 in that the pad triggering system generates basic MIDI, key-velocity messages. Upon touching or activating any of the pads 66, of any of the keyboards 62 and/or 64, the key-velocity prime parameters of pitch, velocity and channel are directed to the processor assembly as outlined in FIG. 2.

Yet another embodiment of the support keyboard controller as shown in FIG. 8, may be herein termed a pad-wheel, generally indicated as 76. The pad-wheel 76 may be described as a circular or round flat keyboard structure comprising and at least partially defined by a plurality of pads (keys) 78, each being substantially equally dimensioned and configured and collectively disposed into the aforementioned round or circular configuration. Further, each of the pads 78 has a generally triangular configuration or "pie" shape extending from an outer circumference 79 towards and into a contiguous relation with a central member 80. While the actual number of pads may vary, one preferred embodiment is the inclusion of 12 such pads 78 separated from each other by separating borders or dividing lines 82, which may have a similar or equivalent structure to the border lines 68 in the embodiment of FIG. 6. Each of the pads 78 are formed on a horizontally oriented planar surface and are touch sensitive and accordingly fixed, similar to the activation technique associated with the plurality of pads 66, 66' in the embodiment of FIGS. 6 and 7. As set forth above the central member 80 is placed as shown in FIG. 8 and may rest in an outwardly projecting or elevated position relative to the remainder of the pads 78. To allow a performing musician to instantly recognize and effectively play individual pads around the circular configuration, predetermined numbers or groups of the pads 78 are distinguished by different colors such as blue and white. In the embodiment of FIG. 8 the pad-wheel 76 is divided into four quarters and is primarily designed for play by utilizing a sliding action, wherein a single finger tip moves across the pads in a circular or spiral path, thereby triggering individual adjacent pads 78 in a sequential manner. The sliding direction may be clockwise or counter-clockwise for "forward play" or "backward play" respectively. In order to facilitate the sliding action and better allow the musician or user to continuously slide along the plurality of pads 78, the pad-wheel 76 includes at least one but preferably a plurality of circularly configured border or segment lines 83 and 83'. The disposition of the circular segment or border lines 83 and 83' allows the player to easily determine, without actually viewing or looking at the pad-wheel 76, the location of his or her finger as it slides along the plurality of pads 78. Accordingly, the provision of two such border or segment lines 83 and 83' creates three concentrically disposed "paths" which may or may not be followed by the finger of the player, depending upon a particular playing style.

Like the pad-ribbon support keyboard controller 60,60' of the embodiment of FIGS. 6 and 7, the pad-wheel 76 integrates its function with the processor assembly as described in detail with reference to FIG. 2. Due to its circular or round configuration, the pad wheel 76 is not provided in duplicate thereby limiting the musician's ability to "automatically" change "playsets" as is possible when utilizing the main keyboard controller 20 and the support keyboard controllers 60 and 60'. As will be explained in greater detail hereinafter, when performing on any of the embodiments of either the main keyboard controller 20 or the support keyboard controller 60 and 60', the playset automatically changes as the user transfers play action (hand position) from one keyrow to another. However, since only a single pad-wheel is provided, the central member 80 is used as a switching structure, to the extent that the player or musician physically engages or otherwise activates the central member 80 each time it is desired to change the playset and progress in the sequence of scripted playsets as indicated in FIG. 9. The difference in the elevation of the central member 80 from the remainder of the keys 78 facilitates the location, by the user or musician, when it is desired to change playsets. As with the embodiments of FIGS. 6 and 7, the contact or activation of the individual pads 78 triggers basic MIDI, key-velocity messages to the extent that the touching or releasing of any of the individual pads 78 generates the pitch, velocity and channel parameters as each pad 78 has unique parameters as described in detail with regard to the embodiment of FIG. 2. One advantage of the pad-wheel support keyboard controller over the remainder of the embodiments set forth herein is that the plurality of keys 78 of the keypad wheel 76 can be operated so as to call up an event sequence of any size, without limitations. This is accomplished by a finger tip of the player or musician continuously rotating around the keypads in sequential circular paths, thereby effectively continuously playing more than the 12 wheel pads 78, when movement of the player's finger travels continuously around the pad wheel 76. Each circle or loop completed by the musician's finger adds 12 more key or pad events to the music being performed and of course results in the ability to "slide play" extremely long musical figures and phrases.

With regard to the embodiment of FIG. 9 a "script", is prepared by the musician or player writing down the musical segment or completed composition and defining such script as a plurality of data entries which, in turn, defines the database assembly 26. Accordingly, when utilizing the main keyboard controller 20 as well as all of the support controllers of the embodiment of FIGS. 6 through 8, data entries, descriptive of the music to be played, encompass two musical tracks. The left hand plays track number 1 and the right hand plays track number 2. This script of FIG. 9 is nothing else than a standard data entry form used to gather the individual playset information. Specifically, in the case of FIG. 9, the script represents the database in its minimal or most simple form or illustration. If the musician wants to play out either a brief musical segment or alternatively a complete song or composition the individual playsets for each track (each hand of the user) is set forth in the proper sequence. In the preparation of the script of FIG. 9, keyrow keys are simply defined as 1, 2, 3, 4, 5, in a left to right order. In addition symbols G1, G2, G3, G4, and G5 are used to name keyrow keys in a general left to right order, regardless of the keyrow. The FIG. 9 script includes two playset system blocks of track one and track two which, as set forth above, correspond to a left hand track and a right hand track. Keyrow keys are identified by the generic names G1 through G5 as set forth above. There are 14 playsets written for the left hand track, numbers 1 through 14 and there are 9 playsets written for the right hand track, numbers 1 through 9. The MIDI pitch value may be entered in each data entry cell, wherein each cell associates a concrete playset/key event with a specific tone. Most cell entries in FIG. 9 are filled out with MIDI pitch values representing specific tones. Cells that are left empty indicate that there is no event defined for that particular playset/key event. Key strokes performed at those points will simply be mute.

Once the script of FIG. 9 is completed with the appropriate MIDI data, the song or composition is ready to play, in that the script of FIG. 9 now represents a part of the database (individual predetermined data entries) defining the database assembly 26 of FIG. 2. When the performance first begins, access will be provided to the first playset. The context of playset 1 rules the beginning of the play. As the musician progresses and successively switches keyrows, the next sequentially oriented playset on the list or script of FIG. 9 will be automatically accessed. Playsets are always accessed in sequential order of the indicated playset 1, playset 2, playset 3, and so on until the last playset has been performed. Each hand of the player drives its own playset system independently.

By way of further explanation the song database, as represented in FIG. 9, is organized into the plurality of aforementioned sequential playsets. It is a collection of these playsets, also referred to herein as predetermined data entries, that comprise the database assembly 26. The playset is a set of MIDI information which defines and controls one keypad, one keyrow at a time. The playset assigns a control data string for each keyrow key. In its most basic implementation, piano play, a playset contains only a set of MIDI pitch values as its contents. As such, each keyrow key is assigned a pitch value element of its own. Therefore, the song database automatically supplies the keyboard with the basic element in music, the tone. When utilizing the main keyboard controller 20, a playset turns a keyrow into a small, 5 key piano keyboard, ready to play five specific tones. Each key triggers a pre-written tone of its own. The name playset suggests a set of keys, or a set of tones which when played are equivalent to the aforementioned scripted playset. Playsets turn keyrows into ready to play, customized, highly specialized keyboard manuals.

As emphasized above, a song database is played keyrow by keyrow, playset after sequentially disposed playset. However, only one playset, the current playset, is active at a time. The active playset governs the keyrow on which the musician is currently playing. The musician plays the song in sets of five keys, namely, five tones at a time. In order to play a keyboard song all the way from beginning to end, the synthesizer assembly of the present invention reads a number of playsets in sequential order. It starts with the first playset, as designated in the script of FIG. 9, and moves onward gradually accessing the second, third and other sequential playsets, until it reaches the last playset in the scripted database. As emphasized throughout, each time the musician switches to a different keyrow, the operative component of the synthesizer assembly, particularly described with reference to FIG. 2, automatically accesses or retrieves the next available playset.

In operation once a song database has been activated, the synthesizer begins at playset 1 and waits. The musician plays on a prescribed keyrow. Playset 1 tones are produced by the activation of the individual keys on the current keyrow being played. After a while, the musician moves on to the opposite keyrow (switches between keyrows 33, 33' and/or 35, 35' of the keypads 34 and 36). The synthesizer, upon the musician changing keyrows is directed instantly to the next sequential playset. Playset 2 produces the indicated tones. Again after a while the musician switches over to the opposite keyrow. The synthesizer points to the next playset or playset 3, instantly. The playset 3 tones are produced. This procedure continuous in the same fashion until the last playset is reached and played out. At that point the song is performed completely.

Therefore, it can be seen that the musical synthesizer assembly of the present invention makes a playset active and uses it to map a keyrow, namely the keyrow on which the musician is currently playing. As long as the musician stays on the keyrow, the current playset governs play. The keyrow behaves like a piano mini keyboard in that each key faithfully and steadily triggers a predetermined pitch value assigned to it time and time again.

As set forth above, as soon as the synthesizer assembly detects a change of keyrow by a movement of the hand of the user, the system automatically and instantly switches over to the next playset. The exception to this procedure is the embodiment of FIG. 8, wherein utilization of the support keyboard controller defined by pad-wheel 80, requires the musician to physically engage or otherwise activate the central member 80 in order to change playset.

The play activity performed by the keyboard controller 20, as described and set forth above, may be further improved and expanded by allowing at least one key within the active keyrow of the various keyboard embodiments to serve as a manual switch which, when touched or otherwise activated, will cause the switching of playsets on its own. This is distinguished from the above noted description of the included embodiment, wherein the playsets are "automatically" switched by the positioning of a player's hand on an adjacent and/or associated keyrow of a given keypad structure. This procedure provides additional technical and musical advantages in association with the keyboard controller 20, regarding play effectiveness issues and the repetition of playsets.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A musical synthesizer assembly comprising:

a. a keyboard assembly including at least one keyboard controller, b. a synthesis engine structured to generate a predetermined sound output comprising a plurality of audio signals, c. a database assembly comprising a plurality of predetermined data entries collectively varying from individual musical segments to complete musical compositions, d. a processor assembly responsive to said keyboard assembly to receive predetermined MIDI language parameters and operatively communicating with said database assembly to select said predetermined data entries therefrom, and e. said processor assembly further structured to communicate a complete MIDI message output to said synthesis engine, said complete MIDI message output determinative of said predetermined sound output.

2. An assembly as recited in claim 1 wherein said one keyboard controller comprises a main keyboard including two keypads each dimensioned and configured to be operated by a different hand of a user and each keypad including at least five keys.

3. An assembly as recited in claim 2 wherein each of said keypads includes an ergonomic configuration corresponding to either a left hand or a right hand of the user.

4. An assembly as recited in claim 3 wherein said two keypads are disposed in spaced apart relation and are oriented for independent access by the corresponding hands of the user.

5. An assembly as recited in claim 2 wherein each of said two keypads comprise two keyrows each of which include at least five keys.

6. An assembly as recited in claim 5 wherein each of said keyrows includes six keys.

7. An assembly as recited in claim 5 wherein each of said keypads includes an ergonomic configuration corresponding to either a left hand or a right hand of the user.

8. An assembly as recited in claim 7 wherein said ergonomic configuration of each of said keypads is at least partially defined by each of said keyrows disposed in longitudinally spaced relation to one another and said keys of each of said keyrows disposed in laterally spaced relation to one another.

9. An assembly as recited in claim 7 wherein said ergonomic configuration is at least partially defined by each of said keyrows disposed in an arcuate array.

10. An assembly as recited in claim 9 wherein said keys of each of said keyrows are individually disposed for engagement by a corresponding finger of a corresponding hand of the user.

11. An assembly as recited in claim 10 wherein each of said keys of each of said keyrows are disposed in laterally spaced relation to one another.

12. An assembly as recited in claim 11 wherein correspondingly positioned ones of said keys in each of said keyrows are longitudinally spaced from one another and are accessible by either a forward or rearward extension of a corresponding hand of the user.

13. An assembly as recited in claim 12 wherein said keyboard assembly further comprises at least one support keyboard controller including a pad-ribbon structure, said pad ribbon structure including a plurality of at least two keyboards each having an elongated substantially linear configuration, each keyboard comprising a plurality of pads disposed in laterally adjacent relation to one another and extending along a length of said keyboard.

14. An assembly as recited in claim 13 wherein said pad-ribbon comprises at least two keyboards separably positioned in adjacent parallel relation to one another.

15. An assembly as recited in claim 14 wherein said plurality of pads of each of said keyboards are fixedly mounted in coplanar relation to one another and are electronically actuated.

16. An assembly as recited in claim 13 further comprising at least one other support keyboard controller including a pad-wheel, said pad wheel including a plurality of pads disposed in adjacent relation to one another and collectively arranged in a circular array.

17. An assembly as recited in claim 16 wherein said pad-wheel comprises a central member comprising a switch assembly operable to change playsets.

18. An assembly as recited in claim 16 wherein each of said pads includes an triangular configuration.

19. An assembly as recited in claim 16 wherein said pad-wheel includes a control member centrally disposed within said circular array, each of said pads being equally dimensioned and extending from an outer circumference of said circular array to said control member.

20. An assembly as recited in claim 19 wherein said plurality of pads comprise a plurality of angularly configured path segments concentrically disposed around said control member of said pad-wheel.

21. An assembly as recited in claim 20 wherein said control member comprises a switch assembly selectively operable to change playsets.

22. An assembly as recited in claim 1 wherein said processor assembly comprises a retrieve processor and an assemble processor, said retrieve processor responsive to said keyboard controller and operatively communicative with said database assembly; said assemble processor responsive to both said keyboard controller and said database assembly and operatively communicative with said synthesis engine to determine said predetermined sound output of said synthesis engine.

23. An assembly as recited in claim 22 wherein said keyboard assembly is structured upon activation to generate MIDI language parameters including pitch, velocity and channel, at least one of said MIDI language parameters communicated to said retrieve processor and the others of said MIDI language parameters communicated to said assemble processor.

24. An assembly as recited in claim 23 wherein said retrieve processor is structured to select target database information defined by said predetermined data entries from said database assembly dependent on said pitch parameter and further communicate resulting partial MIDI information output from said database assembly to said assemble processor.

25. An assembly as recited in claim 24 wherein said assemble processor is operatively communicative with said keyboard assembly to receive said velocity and channel parameters directly therefrom.

26. An assembly as recited in claim 25 wherein said assemble processor is structured to generate a complete MIDI message to said synthesis engine.

27. An assembly as recited in claim 26 wherein said assemble processor is further structured to assemble said complete MIDI message from said velocity and channel parameters received from said keyboard controller and said partial MIDI information received from said database assembly.

28. An assembly as recited in claim 27 wherein said database assembly, said retrieve processor and said assemble processor are cooperatively structured to create said complete MIDI message in real time.

29. A musical synthesizer assembly comprising:

a. at least one keyboard controller including at least two ergonomically configured keypads each disposed and dimensioned to be operated by a different hand of a user, b. a synthesis engine structured to generate predetermined sound output comprising a plurality of audio signals, c. a database assembly including a plurality of predetermined data entries, d. a processor assembly including a retrieve processor and an assemble processor, e. said retrieve processor responsive to said keyboard controller and operatively communicative with said database assembly, f. said assemble processor responsive to both said keyboard controller and said database assembly and operatively communicative with said synthesis engine to determine said predetermined sound output, and g. said retrieve processor and said assemble processor cooperatively structured to communicate a complete MIDI message output to said synthesis engine, said complete MIDI message output determinative of said predetermined sound output generated by said synthesis engine.

30. An assembly as recited in claim 29 wherein said keyboard controller is structured upon activation to generate predetermined MIDI language parameters including pitch, velocity and channel, at least one of said predetermined parameters communicated to said retrieve processor and the others of said predetermined parameters communicated to said assemble processor.

31. An assembly as recited in claim 30 wherein said retrieve processor is structured to select target database information defined by intended ones of said predetermined data entries from said database assembly dependent on said pitch parameter received by said retrieve processor and further communicate resulting partial MIDI information output from said database assembly to said assemble processor.

32. An assembly as recited in claim 31 wherein said assemble processor is operatively communicative with said keyboard controller to receive said velocity and channel parameters directly therefrom.

33. An assembly as recited in claim 32 wherein said assemble processor is structured to generate a complete MIDI message to said synthesis engine; said assemble processor further structured to assemble said complete MIDI message from said velocity and channel parameters received from said keyboard controller and said partial MIDI information received from said database assembly.

34. An assembly as recited in claim 33 wherein said database assembly, said retrieve processor and said assemble processor are cooperatively structured to create said complete MIDI message in real time.

35. An assembly as recited in claim 29 further comprising at least one support keyboard controller operatively communicative with said retrieve processor, said retrieve processor responsive to said support keyboard controller and operatively communicative with said database assembly, said assemble processor responsive to both said support keyboard controller and said database assembly and operatively communicative with said synthesis engine to determine said predetermined sound output of said synthesis engine.

36. An assembly as recited in claim 35 wherein said support keyboard controller comprises a pad-ribbon including a plurality of at least two keyboards each having an elongated linear configuration, each keyboard comprising a plurality of pads disposed in laterally adjacent relation to one another and extending along the length thereof.

37. An assembly as recited in claim 36 wherein said two keyboards are separably positioned in adjacent parallel relation to one another.

38. An assembly as recited in claim 35 wherein said support keyboard controller comprises a pad-wheel including a plurality of pads disposed in adjacent relation to one another and collectively arranged in a circular array.

39. An assembly as recited in claim 38 wherein said pad-wheel comprises a central member including a switch assembly operable to change playsets; each of said pads including a triangular configuration and being equally dimensioned and extending from an outer circumference of said circular array to said central member.

40. An assembly as recited in claim 39 wherein said pad-wheel comprises a plurality of annularly configured path segments formed on an exposed exterior of said plurality of pads and concentrically positioned around said control member.

41. A musical synthesizer assembly comprising:

a. a keyboard assembly including at least one keyboard controller, b. a synthesis engine structured to generate a predetermined sound output comprising a plurality of audio signals at least in response to selective actuation of said keyboard controller, c. said keyboard controller comprising a main keyboard including two keypads each dimensioned and configured to be operated by a different hand of a user and each keypad including at least five keys, and d. said keyboard controller further comprises a pad-ribbon including a plurality of at least two keyboards each having an elongated linear configuration, each keyboard comprising a plurality of pads disposed in laterally adjacent, sequentially actuatable relation to one another and extending along a length of said keyboard, the sequential actuation of said plurality of pads simulating strumming of a stringed instrument.

42. A musical synthesizer assembly comprising:

a. a keyboard assembly including at least one keyboard controller, b. a synthesis engine structured to generate a predetermined sound output comprising a plurality of audio signals at least in response to selective actuation of said keyboard controller, c. said keyboard controller comprising a main keyboard including two keypads each dimensioned and configured to be operated by a different hand of a user and each keypad including at least five keys, and d. said keyboard controller further comprises a pad-wheel including a plurality of pads disposed in adjacent, sequentially actuatable relation to one another and collectively arranged in a circular array so as to permit continuous sequential actuation thereof.

43. An assembly as recited in claim 42 wherein said pad-wheel comprises a plurality of annularly configured path segments formed on an exposed exterior of said plurality of pads and concentrically positioned around a central control member.

* * * * *